US006953884B2

(12) United States Patent
Dennis et al.

(10) Patent No.: US 6,953,884 B2
(45) Date of Patent: Oct. 11, 2005

(54) BASS DRUM BEATER

(75) Inventors: Denny R. Dennis, Garden Grove, CA (US); Marcel R. Daignault, 823 S. Westvale Dr., Anaheim, CA (US) 92804

(73) Assignee: Marcel R. Daignault, Anaheim, CA (US)

( * ) Notice: Subject to any disclaimer, the term of this patent is extended or adjusted under 35 U.S.C. 154(b) by 0 days.

(21) Appl. No.: 10/163,040

(22) Filed: Jun. 5, 2002

(65) Prior Publication Data

US 2003/0226442 A1 Dec. 11, 2003

(51) Int. Cl.[7] ..... G10D 13/02
(52) U.S. Cl. ..... 84/422.1; 84/422.2
(58) Field of Search ..... 84/422.1, 422.2, 84/422.3

(56) References Cited

U.S. PATENT DOCUMENTS

| | | | | |
|---|---|---|---|---|
| 4,346,638 | A | 8/1982 | Hoshino | |
| 4,691,613 | A | 9/1987 | Jacobson | |
| 5,574,237 | A | 11/1996 | Yanagisawa | |
| 5,591,929 | A | 1/1997 | Wellman | |
| 6,137,040 | A * | 10/2000 | Hoshino | 84/422.1 |

* cited by examiner

*Primary Examiner*—Kimberly Lockett
(74) *Attorney, Agent, or Firm*—Richard E. Bee

(57) ABSTRACT

A drum beater for beating a bass drum is described. The drum beater includes a circular beater head having a reduced thickness around it's outer circumference for providing a relatively narrow outer extremity for striking the drumhead of the bass drum. The drum beater further includes a beater stem having one end secured to the beater head and having the other end extending outward from the beater head for attachment to a foot pedal mechanism.

4 Claims, 3 Drawing Sheets

BASS DRUM BEATER

BACKGROUND OF THE INVENTION

This invention relates to foot pedal operated drum beater mechanisms for beating bass drums.

Bass drum pedal mechanisms have been the subject of a goodly number of patents. Representative patents are U.S. Pat. No. 4,346,638 granted to Masao Hoshino on Aug. 31, 1982, U.S. Pat. No. 4,691,613 granted to Luke Jacobson on Sep. 8, 1987 and U.S. Pat. No. 5,574,237 granted to Mitsuo Yanagisawa on Nov. 12, 1996. The various prior art patents appear to have one thing in common. They are concerned with the actuator mechanisms and linkage mechanisms which connect the foot pedal to the hammer or beater head which strikes the drum. They don't appear to be concerned with the construction of the beater head itself. They merely show the conventional marshmallow-shaped beater head which is usually made of a felt material.

Applicants' have discovered that improved and desirable drum sounds can be produced by providing unique constructions for the beater heads which strike the drum membranes.

SUMMARY OF THE INVENTION

A bass drum beater constructed in accordance with the present invention comprises a circular beater head having a reduced thickness around it's outer circumference for providing a relatively narrow outer extremity for striking a drumhead. Such bass drum beater further includes a beater stem having one end secured to the beater head and having the other end extending outward from the beater head for attachment ro a foot pedal mechanism. The narrow outer extremity of the beater head provides a more focused attack on the drum membrane. This produces a crisper, sharper drum sound.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE ILLUSTRATED EMBODIMENTS

Figure 1:
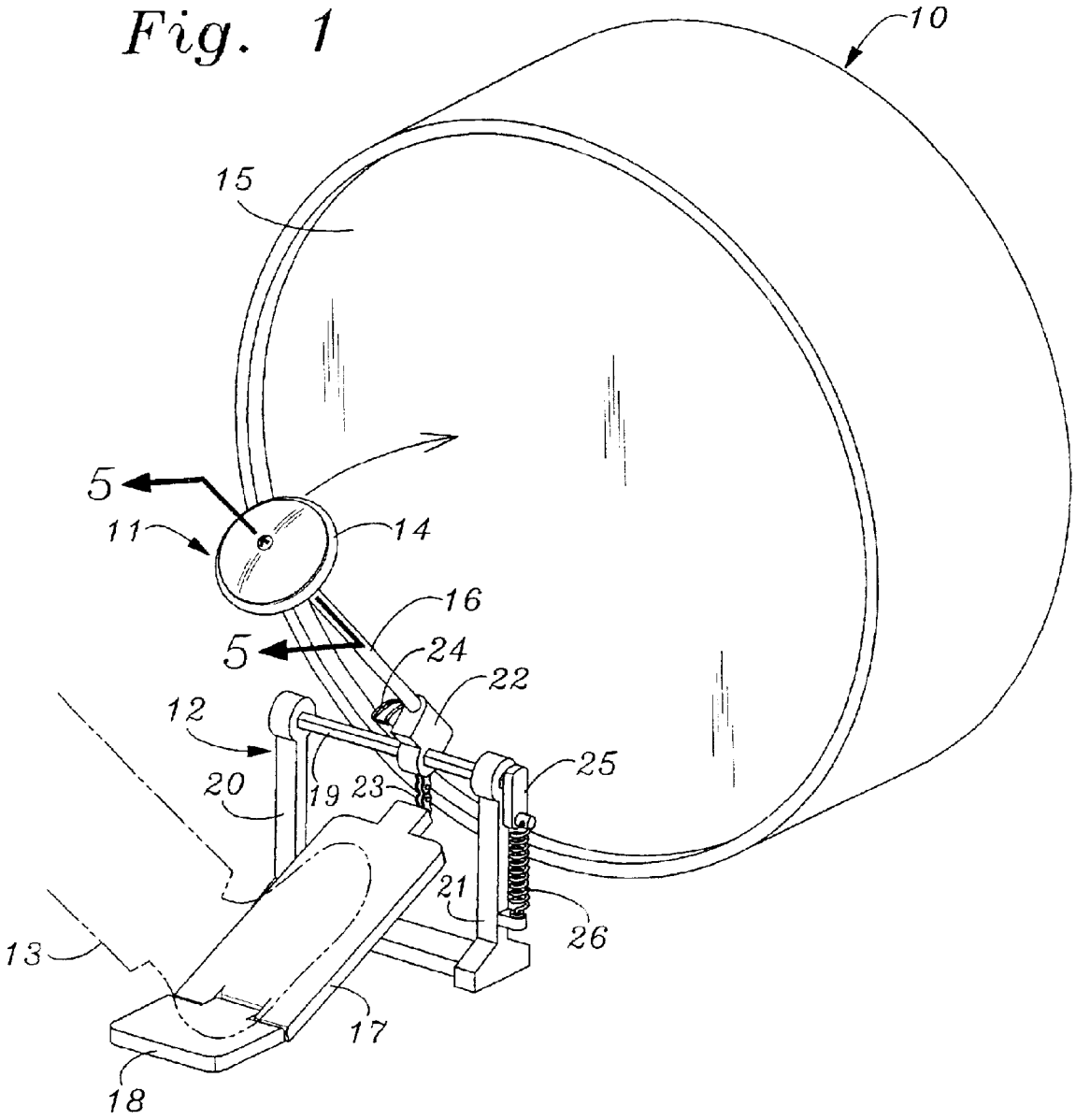
FIG. 1 is a perspective view of a bass drum, a drum beater and a foot pedal mechanism for causing the drum beater to strike the drum, the drum beater being constructed in accordance with the present invention.

Referring to FIG. 1, there is shown a bass drum 10, a drum beater 11 and a foot pedal mechanism 12 for causing the head of drum beater 11 to strike the drum 10. The leg and foot of a drummer are shown in phantom at 13.

Drum beater 11 includes a circular beater head 14 having a reduced thickness around it's outer circumference for providing a relatively narrow outer extremity for striking the drumhead or membrane 15 of bass drum 10. Drum beater 11 also includes a beater stem 16 having one end secured to the beater head 14 and having the other end extending outward from the beater head 14 for attachment to the foot pedal mechanism 12.

Foot pedal mechanism 12 includes a foot pedal 17 pivotally hinged to a heel plate 18. Foot pedal mechanism 12 further includes a rotatable crossbar 19, the ends of which are rotatably journalled at the upper ends of a pair of vertically-extending support members 20 and 21. A stem holder 22 is mounted on the crossbar 19 and moves with rotation of crossbar 19. The lower end of beater stem 16 is mounted in a borehole in stem holder 22. A linkage chain 23 is connected between the forward end of foot pedal 17 and a cam member 24 which is located in a fixed position on the side of stem holder 22. A crank arm 25 is attached to the right end of crossbar 19. A return spring 26 is connected between the outer end of crank arm 25 and a connector post on the lower end of vertical support member 21.

Figure 2:
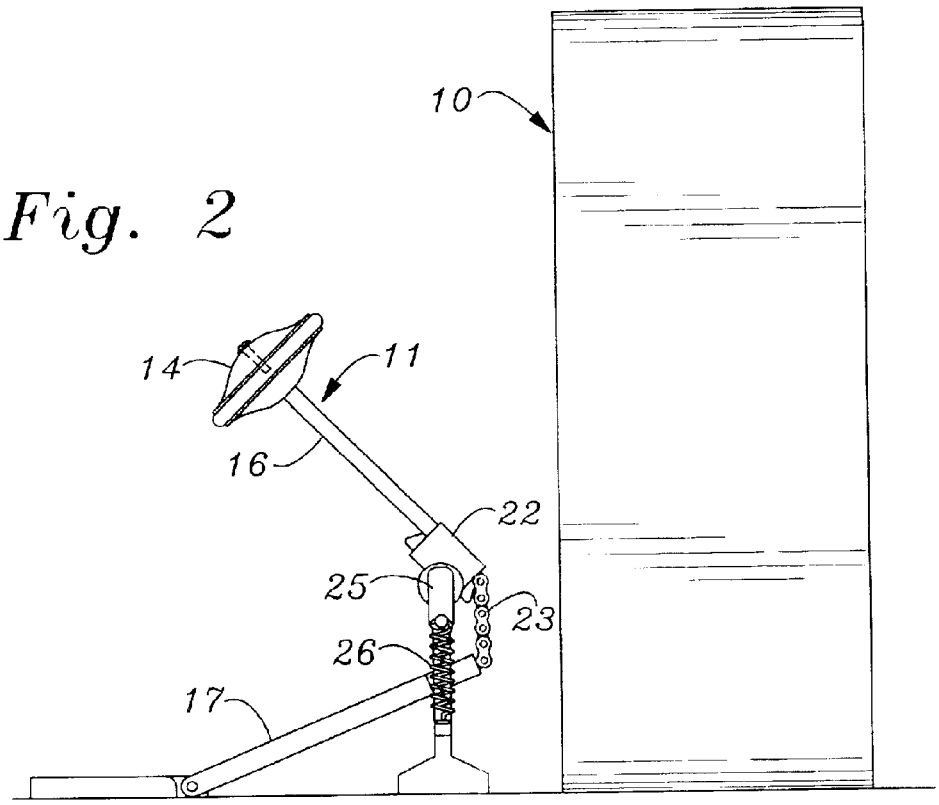
FIG. 2 is a side elevational view of the FIG. 1 apparatus showing the drum beater in a rest position.
Figure 3:
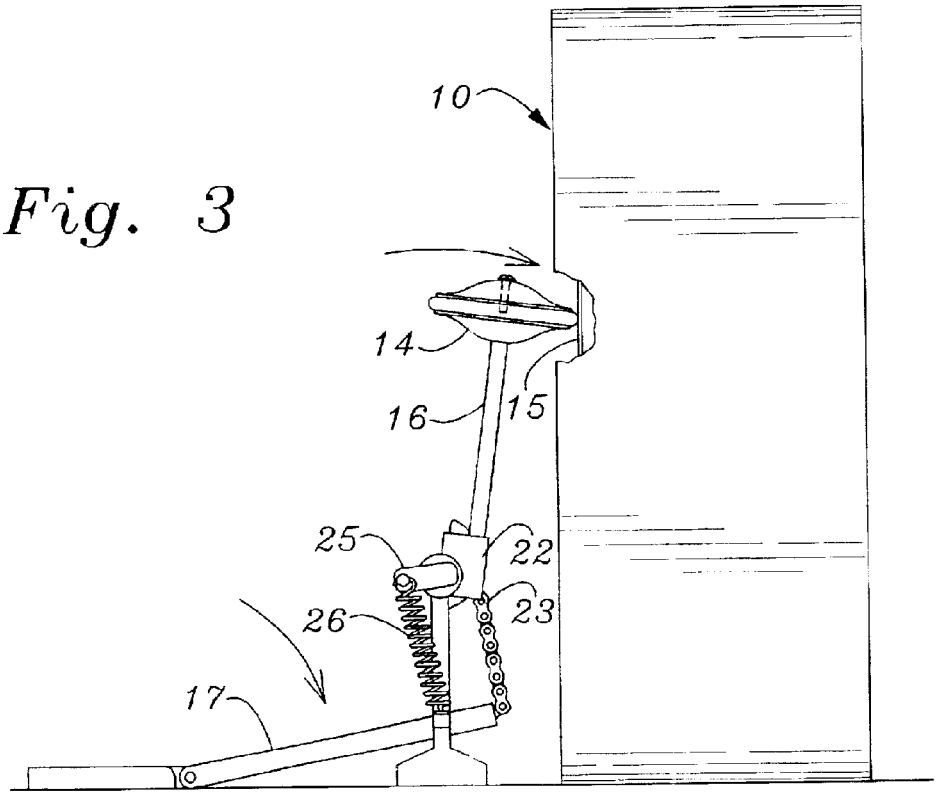
FIG. 3 is a side elevational view of the FIG. 1 apparatus showing the drum beater in a drum striking position.

FIG. 2 shows the beater head 14 and foot pedal 17 in the at rest or non-strike position. FIG. 3 shows these elements in a drum striking position. When the foot pedal 17 is depressed, linkage chain 23 is pulled down to cause rotation of stem holder 22 and the crossbar 19. This moves the beater stem 16 and beater head 14 toward the bass drum 10 and causes the beater head 14 to strike the playing surface or membrane 15 of drum 10. Rotation of crossbar 19 rotates the crank arm 25 to the position shown in FIG. 3. This stretches return spring 26 to the stretched condition shown in FIG. 3. When the downward pressure on foot pedal 17 is released, return spring 26 returns to the at rest position shown in FIG. 2. The accompanying rotation of crossbar 19 and stem holder 22 returns beater stem 16 and beater head 14 to the at rest position shown in FIG. 2 and the drum beater 11 is ready for the next drum beat.

Figure 4:
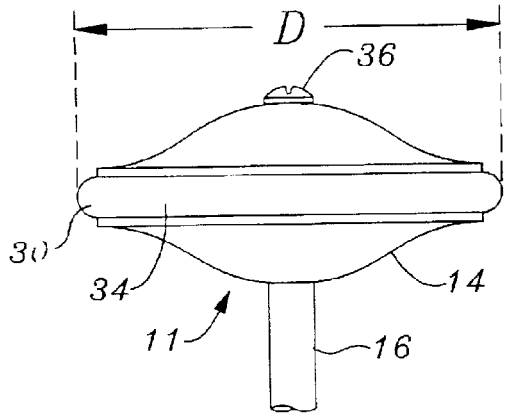
FIG. 4 is an elevational view of the drum beater of FIG. 1.
Figure 5:
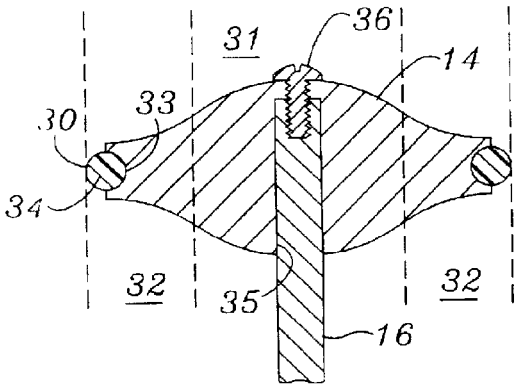
FIG. 5 is a cross-sectional view of the drum beater of FIG. 4, taken along section line 5—5 of FIG. 1.

FIG. 4 is an elevational view of the drum beater 11 of FIG. 1. FIG. 5 is a cross-sectional view of this same drum beater, taken along section line 5—5 of FIG. 1. As seen in FIGS. 4 and 5, the beater head 14 has a reduced thickness around it's outer circumference 30 for providing a relatively narrow outer extremity for striking the drumhead. Also, this outer edge 30 is of rounded shape. Beater head 14 is a circular disk-shaped body which, as indicated in FIG. 5, has an enlarged central portion 31 and an outer peripheral portion 32 of lesser thickness for providing a relatively narrow outer extremity 30 for striking a drumhead. The thickness of the outer peripheral portion 32 near the outer edge 30 may be, for example, on the order of one-quarter the thickness of the central portion 31 at the center of the beater head 14.

Beater head 14 has an outwardly-facing circumferential groove 33 formed in it's outer edge. An O-ring 34 is mounted in this circumferential groove 33 and provides the drumhead striking surface.

Beater stem 16 may take the form of, for example, an elongated cylindrical rod having it's upper end secured to the center of the beater head 14. One method of attachment is shown in FIG. 5. As there indicated, a central passageway 35 is drilled into the body of the beater head 14 in the center thereof and at right angles to the principal radial dimension D (FIG. 4) of the beater head 14. The upper end of beater stem 16 is secured in this central passageway 35 by means of a threaded fastener 36 which extends downward through a small borehole in the top of beater head 14 and is screwed into the top end of beater stem 16.

The body of beater head 14 is preferably composed of a material selected from a group consisting of metal, plastic and rubber. A body made of aluminum has been found to provide the desired performance characteristics. The O-ring 34 is preferably composed of a material selected from a group consisting of rubber, plastic, leather, felt and Nylon. The beater head 14, including the O-ring 34, preferably should have a weight in the range of 30 to 70 grams. A weight of approximately 60 grams has been found to provide satisfactory performance characteristics.

Figure 6:
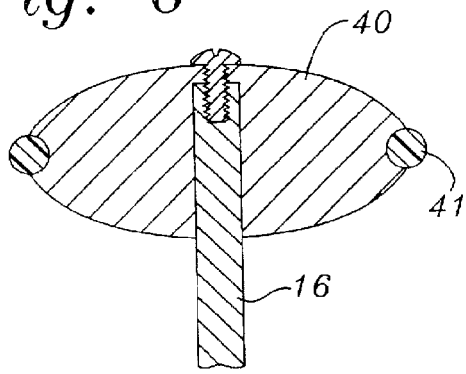
FIGS. 6–8 are cross-sectional views similar to FIG. 5 but showing modified shapes and constructions for the beater head portion of the drum beater.

FIG. 6 shows a beater head 40 of somewhat different shape. It has more of a pillow shape and is made of aluminum. It has an O-ring 41 mounted in a circumferential groove which extends around the outer periphery of beater head 40. Beater head 40 has an enlarged central portion and an outer peripheral portion of lesser thickness. The outer surface of O-ring 41 provides the drumhead striking surface.

Figure 7:
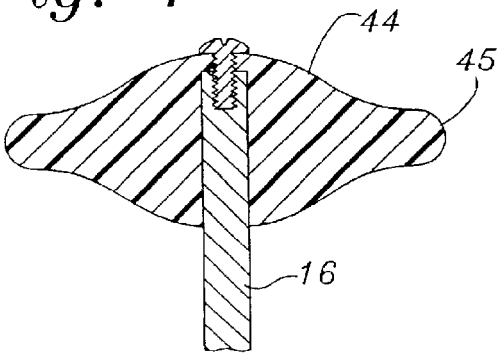

FIG. 7 shows a beater head 44 which does not employ an O-ring. Instead, the body of beater head 44 is composed entirely of a firm but resilient rubber or plastic material having a rounded outer edge 45 which provides the drum striking surface. The use of a resilient material minimizes damage to the membrane of the drum.

Figure 8:
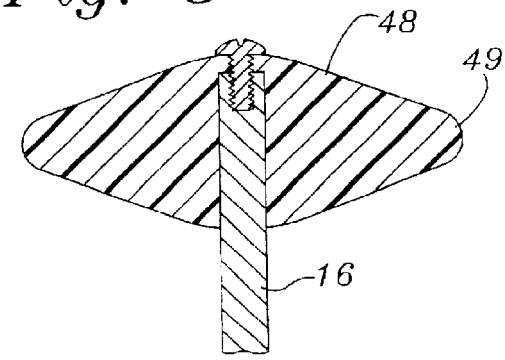

FIG. 8 shows another form of beater head 48 which does not use an O-ring. The body of beater head 48 is formed of a firm but resilient material such as rubber or Nylon. Beater head 48 has a hatchet-shaped cross sectional form. It's rounded outer edge 49 provides the drumhead striking surface.

Figure 9:
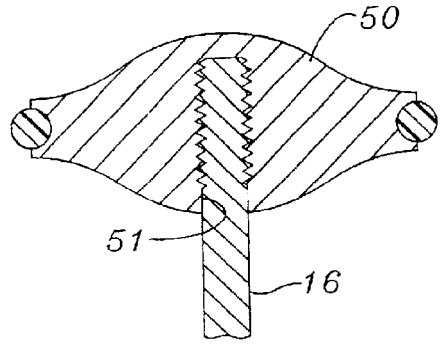
FIG. 9 is a cross-sectional view showing an alternative construction for connecting a beater stem to the beater head.

FIG. 9 shows an alternative method for attaching the beater stem 16 to a beater head. For sake of example, the beater head 50 shown in FIG. 9 is selected to be of the same form and construction as the beater head 14 of FIGS. 4 and 5, except that no top screw 36 is used. Instead, the central stem-receiving passageway 51 in beater head 50 is internally threaded over at least a portion of the length thereof. The upper portion of beater stem 16 is externally-threaded with threads that mate with the passageway threads. Beater head 50 is secured to the beater stem 16 by screwing it onto the beater stem threads. Thus, no top screw or bolt is needed. This FIG. 9 attachment method may be used for any of the beater head embodiments shown in FIGS. 4–8.

A uniquely shaped bass drum beater head constructed in accordance with the present invention provides a more focused point of attack on the membrane or playing surface of the drum. This produces a noticeably crisper and sharper sound which improves the quality of various musical renditions.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

What is claimed is:

1. A bass drum beater comprising:

a circular beater head having a reduced thickness around it's outer circumference for providing a relatively narrow outer extremity for striking a drumhead;

and a beater stem having one end secured to the beater head and having the other end extending outward from the beater head for attachment to a foot pedal mechanism;

wherein the beater head includes:

an outwardly-facing circumferential groove formed in it's extremity;

and an O-ring mounted in the circumferential groove for providing a drumhead striking surface.

2. A bass drum beater in accordance with claim 1 wherein the O-ring is composed of a material selected from a group consisting of rubber, plastic, leather, felt and Nylon.

3. A bass drum beater comprising:

a circular beater head having an enlarged central portion and an outer peripheral portion of lesser thickness for providing a relatively narrow outer extremity for striking a drumhead, such beater head having a central passageway extending inwardly into the beater head at right angles to the principal radial dimension of the beater head;

and a beater stem having one end secured in the central passageway of the beater head, such beater stem extending outwardly from the center of the beater head at right angles to the principal radial dimension of the beater head for attachment to a foot pedal mechanism;

wherein the beater head includes:

an outwardly-facing circumferential groove formed in it's outer extremity;

and an O-ring mounted in the circumferential groove for providing a drumhead striking surface.

4. A bass drum beater in accordance with claim 3 wherein the O-ring is composed of a material selected from a group consisting of rubber, plastic, leather, felt and Nylon.

* * * * *